United States Patent [19]

Gary

[11] 4,232,654

[45] Nov. 11, 1980

[54] HEAT RECOVERY DEVICE FOR USE IN RETURN AIR DUCT OF FORCED AIR FURNACE FOR RECOVERING HEAT FROM THE FLUE OF SUCH FURNACE

[76] Inventor: Fred J. Gary, R.F.D. #1, Box 164, Glasco, Kans. 67445

[21] Appl. No.: 22,973

[22] Filed: Mar. 23, 1979

Related U.S. Application Data

[62] Division of Ser. No. 891,171, Mar. 29, 1978, Pat. No. 4,176,787.

[51] Int. Cl.[3] ..... F24H 7/00

[52] U.S. Cl. ..... 126/400; 165/179; 165/DIG. 2; 138/38

[58] Field of Search ..... 126/400; 165/179, 165, 165/DIG. 2; 237/55; 138/38

[56] References Cited

U.S. PATENT DOCUMENTS

| | | | |
|---|---|---|---|
| 1,143,902 | 6/1915 | Haberkorn | 165/179 |
| 1,734,274 | 11/1929 | Schubart | 165/165 X |
| 2,468,909 | 5/1949 | Yeager et al. | 165/DIG. 2 |
| 3,825,063 | 7/1974 | Cowans | 165/146 |
| 3,981,356 | 9/1976 | Granetzke | 138/38 X |
| 4,016,928 | 4/1977 | Bartels et al. | 165/165 X |

*Primary Examiner*—Albert J. Makay
*Assistant Examiner*—William E. Tapolcai, Jr.
*Attorney, Agent, or Firm*—Schmidt, Johnson, Hovey & Williams

[57] ABSTRACT

An especially compact, highly efficient heat recovery device for use in the cool air return duct of a heating system may be easily installed in existing flue pipes and transfers the ordinarily wasted heat in the exhaust gases flowing through the flue pipe to the cool return air thereby preheating the latter and increasing the efficiency of the heating system. The device includes a three stage heat transfer structure housed within a heat conductive tubular member which cooperate to transfer heat away from the gases into the cool return air by means of conduction, convection and radiation processes. A first stage deflects a portion of the gases toward and into heat exchanging contact with the sidewalls of the tubular member and directs the remaining portion into a gas pervious heat storage trap which comprises the second stage. The third stage includes a perforated, heat deflecting and radiating cone structure which cooperates with the first and second stages to produce temperature stratification within the tubular member to further increase heat transfer to the cool return air.

2 Claims, 10 Drawing Figures

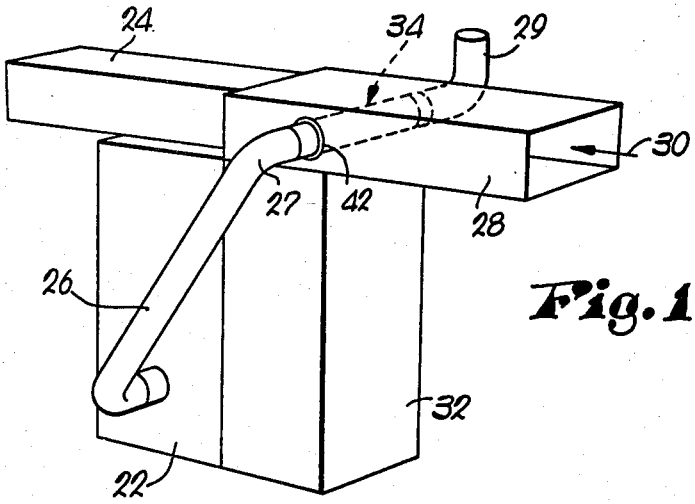
Fig. 1.
Fig. 2.
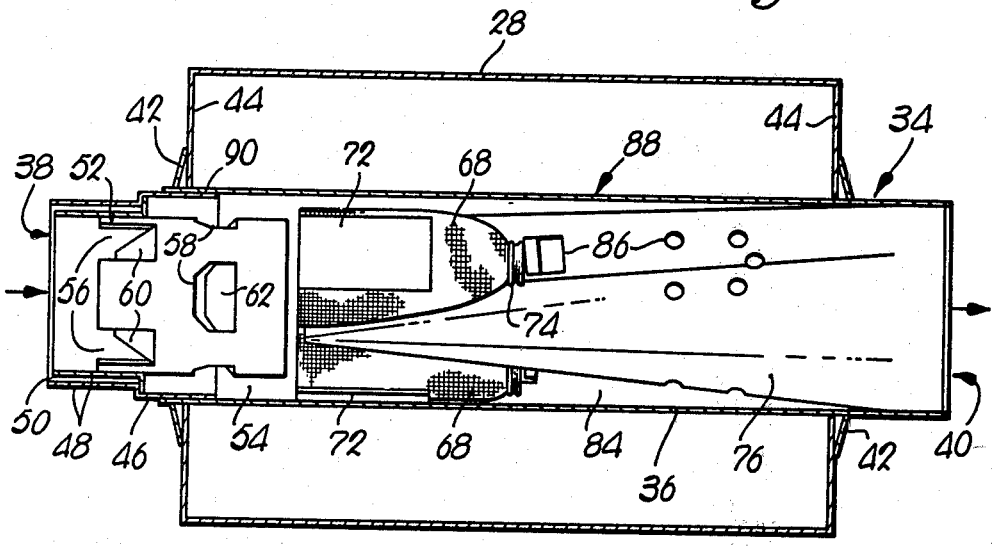
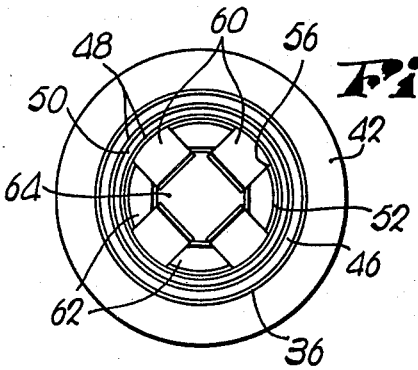
Fig. 3.
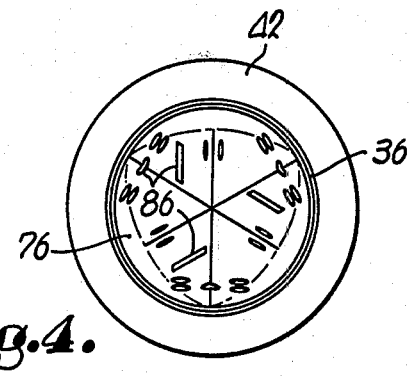
Fig. 4.

HEAT RECOVERY DEVICE FOR USE IN RETURN AIR DUCT OF FORCED AIR FURNACE FOR RECOVERING HEAT FROM THE FLUE OF SUCH FURNACE

This is a division of application Ser. No. 891,171 filed Mar. 29, 1978.

TECHNICAL FIELD

This invention generally relates to apparatus for exchanging or transferring heat, and deals more particularly with a device for use in the return air duct of forced air type furnaces for recovering and effectively utilizing heat from the flue of such furnace.

BACKGROUND ART

The growing concern over energy conservation prompted by limited natural resources has produced a need in the art for further improvements in the design of heating systems which increase operating efficiency and thereby reduce energy consumption. In combustive type heating systems, particularly those burning fossil-type fuels such as coal, gas, or oil, products of combustion and toxic gases are generated and must be drawn away and exhausted from the heating system into the open atmosphere, usually by means of a conduit or "flue pipe". As an energy wasting consequence of this type of system, the exhaust gases include a significant quantity of heat produced by the combustion process which is ordinarily lost to the atmosphere and therefore is not effectively employed for, and does not contribute to, the heating of the area which the heating system is intended to warm.

Others in the past have recognized the important advantage of recovering heat from the exhausted combustion gases, and have attempted to devise means for transferring a small portion of such exhausted heat to the area intended to be heated. These prior art systems are typically employed in forced air-type heating systems for buildings, and include a heating chamber provided with a warm air delivery duct and a cool air intake or return duct while a flue pipe for carrying away the gases and products of combustion is usually in communication with the heating chamber. The flue pipe, which normally comprises a metallic, heat conducting material, is disposed within the cool air return duct so that the cool air returning to the heating chamber passes over the warm surface areas of a short stretch of the flue pipe and is, in effect, slightly preheated prior to return to the heating chamber. In this manner, the air within the heating chamber to be heated is slightly increased, consequently, the energy required to elevate the temperature of the preheated return air to the desired temperature is slightly reduced.

Prior art systems of the general type described above are shown in U.S. Pat. Nos. 2,225,181 and 2,439,109. U.S. Pat. No. 2,225,181 discloses a rather large, concentric shell structure interposed between stretches of the flue pipe and in the path of cold air returning to the furnace through a return air duct, which is designed to transfer a portion of the heat flowing through the flue pipe solely by means of heat conduction and relies on a substantial surface area to maximize the heat transfer process; the apparatus shown by this patent is of limited effectiveness in recovering the wasted heat energy, particularly in view of the substantial size and space requirements for the heat recovering structure. U.S. Pat. No. 2,439,109 also shows the use of heat recovery structure interposed between stretches of a flue pipe disposed within the path of cool air flow in the return duct of a furnace, and includes radiating members presenting a relatively large surface area to the cool return air flowing thereacross in order to maximize the transfer of heat from the gases within the flue by conduction processes to the cooler return air; the heat recovery structure disclosed by this patent requires the use of a baffle means for diverting the combustion gases in the main stream of the flue pipe away from the latter and into the radiating structures. The apparatus disclosed by the latter mentioned patent is also undesirable from the standpoint that the heat exchanging structure is rather large in comparison to the quantity of heat which it recovers, and necessitates the provision of a cool air return duct having a relatively large cross-sectional area to accommodate the same.

DISCLOSURE OF THE INVENTION

A small, compact, but highly efficient heat recovery device adapted for simple and rapid installation between stretches of a flue pipe includes a straight tubular member extending through spaces within the cool air return duct of a furnace for transferring a substantial portion of the heat in the combustion gases to the cool return air flowing over exterior surface portions of the tubular member. The tubular member houses heat transferring structure including a first, second, and third stage which sequentially operate on the combustion gases flowing therethrough, by means of conduction, convection, and radiation, in order to extract a maximum quantity of the heat in such gases and transfer such heat to the exterior surface areas of the tubular member, and are novelly arranged within the tubular member to produce stratification of the heat in the gases flowing through the member.

The first stage of the heat recovery device comprises deflection structure for diverting a portion of the gas flow toward and into heat conducting contact with the circumferential interior walls of the tubular section, and further includes a cylindrical sleeve coaxially located within the tubular member and slightly spaced from the sidewalls of the latter which confines the flow of the diverted portion of the gas and creates an entrance friction which further contributes to heat transfer between the gases and the cool return air. A perforated partition enclosing one end of the cylindrical sleeve of the first stage reduces the flow volume of the gases to the second stage and produces a pressure drop in going from the first stage to the second stage while directing a portion of the flow of the gases into the second stage. The second stage is disposed downstream from the first stage and comprises a plurality of longitudinally extending, gas pervious, mesh-like structures circumferentially spaced around the interior walls of the tubular member and in heat conductive relationship to the latter. The third stage of the device comprises a longitudinally extending, generally hollow, conically shaped baffle structure having the base end thereof disposed downstream from the first and second stages and contacting the interior sidewalls of the tubular member in order to further reduce the rate at which the gases are allowed to flow through the tubular member. The mesh-like structures of the second stage are nested between the tapering sidewalls of the third stage baffle structure and the interior sidewalls of the tubular member. The tapering sidewalls of the baffle structure function to reflect and radiate heat stored within the mesh-like structures in a direction toward the interior surface portions of the tubular member, while a plurality of perforations are provided in such tapering sidewalls to allow the gases to be drawn into the baffle structure, and out the open base thereof away from the tubular member.

By this compact three stage arrangement of heat transferring units, an increased quantity of heat may be transferred from the flue gases to the cool return air in comparison to known prior art devices, consequently, the present arrangement may be disposed within the confines of existing flue pipes presenting a relatively small exterior surface area to the flow of cool return air and obviates the need for bulky heat exchanging structures presenting large surface areas to the flow of cool return air heretofore required.

BRIEF DESCRIPTION OF THE DRAWINGS

In the drawings:

FIG. 1 is a perspective view of portions of a conventional air heating furnace showing the heat recovery device which forms the currently preferred embodiments of my invention installed between stretches of a flue pipe and disposed within the cool air return air duct of the furnace;

FIG. 2 is a longitudinal, sectional view of the preferred form of the invention shown in FIG. 1, depicting the device in its mounted position within the return air duct, arrows indicating the direction of gas flow through the device;

FIG. 3 is a view of one end of the device shown in FIG. 2 through which gases enter;

FIG. 4 is a view of the opposite end of the device shown in FIG. 2 from which gases exit;

BEST MODE FOR CARRYING OUT THE INVENTION

Figure 5:
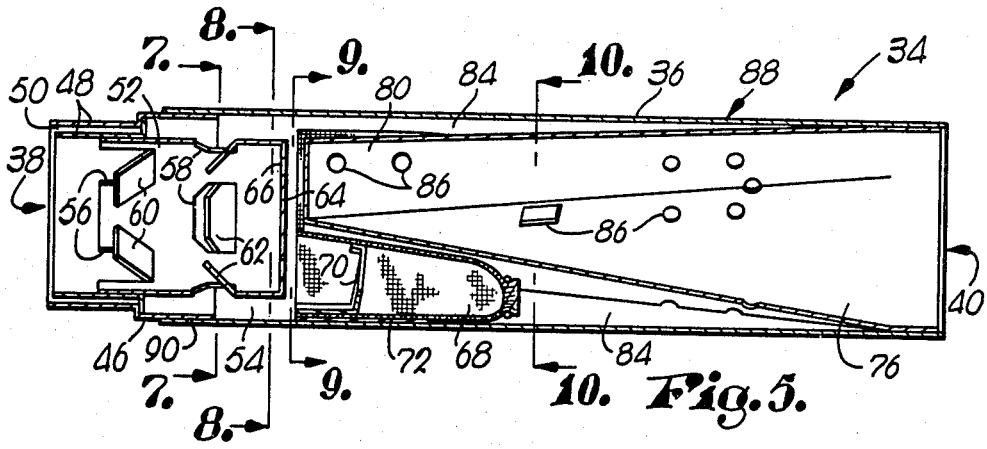
FIG. 5 is a longitudinal, cross-sectioned view of the device shown in FIG. 2.
Figure 6:
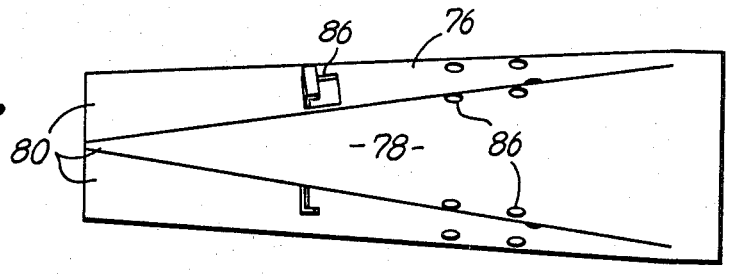
FIG. 6 is a longitudinal view of the third stage unit of the device.
Figure 7:
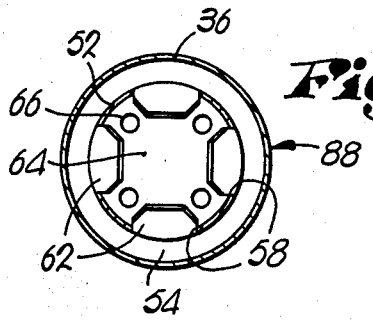
FIG. 7 is a cross-sectional view taken along the line 7—7 in FIG. 5.

Turning attention first to FIG. 1, a furnace system generally indicated by the numeral 20 includes a heating chamber 22, wherein means (not shown) are provided for burning a fuel such as gas, oil, coal, or the like. A warm air delivery duct 24 is in communication with the heating chamber 22 and functions to carry the air warmed within the latter to an area to be heated, while a flue pipe 26 having one end thereof also in communication with the heating chamber 22 is provided to separate the gases and other products of combustion produced by the fuel burning process from the warm air delivered in the duct 24, and functions to carry the same way from the heating chamber 22 for exhaust. A cool air intake duct 28, typically comprising a return air duct in communication with the area to be heated, receives intake air in the direction of the arrow 30 and delivers the cool air to an intake plenum which is in airflow communication with the heating chamber 22. Air moving means (not shown) may be provided within the air plenum 32 for drawing cool air through the cool air duct 28 into the heating chamber 22 and forcing the warmed air out through the warm air duct 24. The flue pipe 26 extends through opposite sidewalls of the cool air duct 28, and has a heat recovery device, generally indicated by the numeral 34, interposed between stretches 27 and 29 of the pipe 26 and within the cool air duct 28. Thus, it can be appreciated that cool air flowing in the direction 30 through the cool air duct 28 flows across exterior surface areas of the heat recovery device and is then drawn through the air plenum 32 into the heating chamber 22, thence into the warm air duct 24 for delivery to the area to be heated.

Referring now also to FIGS. 2 through 10, the heat recovery device 34 comprises an elongate, tubular member 36 of generally circular cross section comprising a heat conductive material such as ordinary sheet metal and includes a gas inlet opening 38 and outlet opening 40 on opposite extremities thereof which openings are respectively coupled with stretches 27 and 29 of the flue pipe 26. In the preferred form of the device 34, the interior surface portions of the tubular member 36 are coated with a heat resistant, black finish to enhance the absorption of heat. The tubular member 36 includes a pair of longitudinally spaced, annular flanges 42 therearound and secured thereto which engage exterior surface portions of the opposed sidewalls 44 of the cool air duct 28, thereby mounting the heat recovery device 34 within the cool air duct 28. An annular reducing flange 46 is secured to the tubular member 36 inside the latter adjacent the inlet opening 38, and includes an attenuated neck portion consisting of a pair of annular, concentric sleeves 48 of differing diameters defining an annular, recessed area 50 for receiving the end of the stretch 27 of the flue pipe 26 therewithin. A generally cylindrically shaped, sleeve or shell member 52, made from a heat conducting material such as ordinary sheet metal, is disposed within the tubular member 36 adjacent the inlet opening 38 and is suitably secured to interior surface portions of one of the sleeves 48. Shell member 52 has the longitudinal axis thereof essentially aligned with the like axis of the tubular member 36, the end of the shell member 52 adjacent the inlet opening 38 being essentially open to receive gases therethrough. Exterior surface portions of the shell member 52 are spaced from interior surface portions of the tubular member 36 and form an annular passageway 54 for confining the flow of gases between the exterior of the shell member 52 and the interior sidewalls of the tubular member 36.

The shell member 52 includes a first set of circumferentially spaced openings 56 in the sidewalls thereof adjacent the inlet opening 38, while a second set of circumferentially spaced openings 58 are also provided in the sidewalls of shell member 52, in central longitudinal stretches of the latter, which place the passageway 54 in gas flow communication with the inlet opening 38. A first set of deflector elements 60 in the nature of rectangularly shaped blades which may be formed integral with the shell member 52 are in respective communication with corresponding ones of the openings 56 and extend axially inward toward the longitudinal axis of the shell member 52, while a second set of similarly configured deflection elements 62 are in communication with the respectively corresponding openings 58, and likewise extend inwardly toward the interior space within the shell member 52. As best seen in FIGS. 2 and 3, the first and second sets of openings 56 and 58 respectively, along with their corresponding sets of deflector elements 60 and 62 are circumferentially staggered or offset with respect to each other, whereby the deflector elements 60 and 62 present deflecting structure to the flow of gas through the tubular member 36 which essentially circumscribes the entire interior surface areas of the shell member 52, but which allows an axially central portion of gas flow to pass through the shell member 52 essentially undisturbed. A circular plate 64 is suitably secured to, and essentially encloses, the end of the shell member 52 distal from the inlet opening 38. Circular plate 64 includes a plurality of circumferentially, and essentially equally radially spaced apertures 66 therethrough placing interior spaces within the shell member 52 in gas flow communication with the outlet opening 40. Shell member 52, including openings 56 and 58, as well as deflector elements 60 and 62 and circular plate 64 form, in combination with the tubular member 36, a first stage in the heat recovery device 34 for effecting the transfer of heat from the gases to the cool air flowing through the cool air duct 28.

Figure 9:
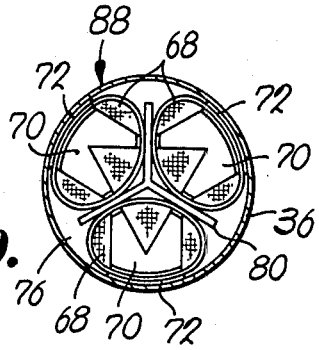
FIG. 9 is a cross-sectional view taken along the line 9—9 in FIG. 5.
Figure 8:
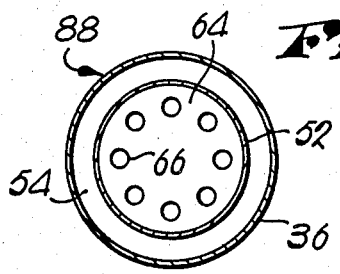
FIG. 8 is a cross-sectional view taken along the line 8—8 in FIG. 5.

A heat storing trap, comprising the second stage of the heat recovery device 34 for effecting the transfer of heat, includes a plurality of circumferentially spaced, longitudinally extending, tubular heat trap structures 68 each having one end thereof distal from the inlet opening 38 essentially closed while the opposite extremity of each thereof proximal to the circular plate 64 is essentially open. Apertures 66 in the circular plate 64 are radially aligned with the open ends of the trap structures 68. The trap structures 68 each comprise an essentially elliptically shaped cross section, as best seen in FIG. 9, and are made from a heat conducting, gas pervious material such as a wire mesh which freely allows gases to pass therethrough. A gas deflection plate 70 having a V-shaped cutout portion therein is disposed within central longitudinal stretches of each of the tubular trap structures 68. Each of the trap structures 68 includes exterior surface portions aligned with, and closely adjoining, the interior surface portions of the tubular member 36 and are secured to the latter by means of a longitudinally extending, heat conducting plate member 72 which conformally engages the interior surface portions of the tubular member 36 and is joined in heat conducting relationship to the latter as well as to the trap structure 68. A fastening means 74 may be employed to crimp one end of the trap structure 68 whereby to close such end.

Figure 10:
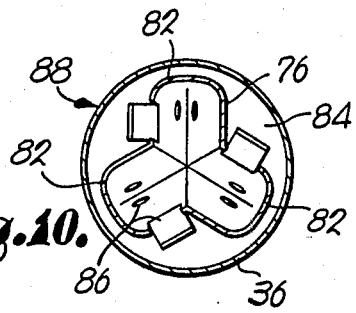
FIG. 10 is a cross-sectional view taken along the line 10—10 in FIG. 5.

The third stage of the heat recovery device 34 comprises a baffle structure 76 made as by forming from a heat conductive material such as sheet metal or the like. Baffle structure 76 includes longitudinally extending, tapering, inclined sidewall portions 78 which form an essentially hollow, generally conically shaped member, having the smaller end thereof distal from the outlet opening 40 essentially closed while the larger base end thereof adjacent the outlet opening 40 is essentially open. The baffle structure 76 includes a plurality of longitudinally extending fins 80 equally circumferentially spaced around the exterior surface areas of the inclined sidewall portions 78, which extend radially outwardly from the longitudinal axis of the baffle structure 76 and function to partially partition the space within the tubular member 36 surrounding the inclined sidewall portions 78 into three spaces of essentially equal volumes. As best seen in FIG. 10, the fins 80 have the longitudinal axes thereof aligned with, and defined by, each of three respectively associated nodes 82 formed by the tapering of the inclined sidewall portions 78. As may be viewed in FIG. 4, the base end of the baffle structure 76 comprises an essentially circular cross section having an outside diameter marginally smaller than the inside diameter of the tubular member 36 and is joined to the latter adjacent the outlet opening 40 thereby preventing the escape of gas through the outlet 40 between the spaces 84 defined between the interior surface portions of the tubular member 36 and the baffle structure 76. The baffle structure 76 includes a plurality of perforations 86 in the sidewall portions 78 and fins 80 thereof, placing the spaces 84 surrounding the exterior of the baffle structure 76 in gas flow communication with the essentially hollow interior space thereof, and thus in communication with the outlet opening 40. As best seen in FIGS. 5 and 9, the elongate trap structures 68 are interposed between the inclined sidewall portions 78 and interior surface portions of the tubular member 36, and are nested in the spaces 84 defined by the fins 80. Portions of the exterior sidewalls of the trap structures 68 conductively contact the inclined sidewall portions 78 and fins 80 of the baffle structure 76.

The heat recovery device 34 may be simply installed by first positioning the tubular member 36 through openings of suitable diameter in opposing sidewalls of the cool air duct 28 and fastening the annular flanges 42 against such sidewalls to securely hold the device 34 in place. Stretch 27 of the flue pipe 26 may then be inserted into the recessed area 50 adjacent the inlet opening 38 of the device 34 and suitably secured in place therewithin. Similarly, stretch 29 of the flue pipe 26 may be slipped over the end of the tubular member 36 adjacent the outlet opening 40 and held there in place by any suitable means.

In operation, the heat recovering device 34 provides a three stage structure for maximizing the transfer of heat from gases flowing through the flue pipe 26 to the cooler air within cool air duct 28 flowing across the exterior surface portions of the tubular member 36 disposed within the duct 28. It can be readily appreciated, however, that the heat recovery device 34 is especially compact and houses the highly efficient three stage heat transferring structure within a tubular member 36 which is of essentially the same diameter of the flue pipe 26, so that the device 34 may be installed in existing heating systems without the need for substantial alteration of heating or cooling ducts to provide additional space for accommodating the same. Assuming now that cool air is being drawn in the direction 30 across the exterior surface areas of the tubular member 36, and into the heating chamber 22 for heating, gases entering the device 34 through the inlet opening 38 first flow into contact with the first set of deflector elements 60 resulting in a portion of the gas flow being diverted through the openings 56 into the annular passageway 54, while a further portion of the gas flow is similarly diverted by the second set of deflector elements 62 through the second set of openings 58 into the passageway 54. As the diverted portion of the gas flow enters the passageway 54, a slight compression of the gases, therewithin results, thereby increasing the conductive heat transfer between the gases within the passageway 54 and the interior surface portions of the tubular member 36 adjacent the shell member 52. Moreover, intimate contacting of the flowing gases with interior and exterior surface portions of the shell member 52 result in the conductive transfer of heat from the gas flow to the shell member 52, which heat is inturn conductively transferred by the member 52 to the interior surface portions of the tubular member 36 at the point of surface contact indicated by the numeral 90. The circular plate 64 functions to restrict the flow of undeflected gases. The apertures 66 in the plate 64 function to direct a major portion of the undeflected gas flow into the open ends of the heat trap structures 64, a minor portion of such undeflected gas flow being directed into the spaces 84 between the baffle structure 76 and the interior surface portions of the tubular member 36. The gases freely flow into the open ends of the heat trap structures 68 and permeate the sidewalls of the latter between the open end thereof and the deflection plates 70. Deflection plates 70 functions to restrict the flow of gases toward the enclosed end of the heat trap structure 68 and thereby tend to evenly distribute the flow of gas out through the pervious sidewalls of the trap structure 68. As the gas flow exits through the pervious sidewalls of the trap structure 68, the sidewalls are heated by conduction, and by virtue of their mesh-like construction, function to trap and store a substantial portion of the heat energy is then partially transferred by conduction through the plate member 72, thence to the interior surface portions of the tubular member 36. Moreover, the deflection plates 70 are likewise heated by conduction, which heat is also conducted through the plate member 72 to the interior surface portions of the tubular member 36. After leaving the heat trap structure 68, the gases flow through the space 84 transferring heat by conduction to both the baffle structure 76 and interior surface portions of the tubular member 36. By virtue of the substantially gas-tight fit between the base of the baffle structure 76 and the interior surface portions of the tubular member 36 adjacent the outlet opening 40, the gases flowing through the spaces 84 are forced to enter the perforations 86 in the baffle structure 76 into the interior spaces of the latter and are then allowed to exit through the outlet opening 40. It can be appreciated that the gases flowing through the tubular member 36 contacts and heats essentially the entire exterior surface area of the baffle structure 76. A portion of the heat extracted by the baffle structure 76 is conducted toward the base thereof and into the interior surface portions of the tubular member 36 adjacent the outlet opening 40. In addition to such conductive heat transfer, the exterior surface portions of the baffle structure 76 function to radiate heat retained thereby toward and onto the interior surface portions of the tubular member 36 essentially the entire length of the baffle structure 76. Moreover, the exterior surface portions of the baffle structure 76 further function to reflect and radiate the heat stored by the heat trap structures 68 toward and onto the interior surface portions of the tubular member 36. On those occasions when the burner or other combustion device employed within the heating chamber 22 is temporarily turned off from time to time, the heat trap structures 68 function to store a certain quantity of heat within the device 34 to maintain the exterior surface portions of the tubular member 36 at a higher temperature level than otherwise.

From the foregoing description of the construction and operation of the heat recovery device 34, it can be appreciated that the three stage structure of the device 34 encourages heat transfer toward the circumferential perimeter of the tubular member 36 through the device 34 to produce a temperature stratification of the gas along the length of the tubular member 36. It may further be appreciated that each of the stages of the heat transferring structure synergistically cooperate with each other by processes of conduction, convection, and radiation to maximize the extraction and transfer of heat from the gases to the interior surface portions of the tubular member 36 for subsequent conduction to the exterior surface areas of the latter, yet the device 34 is especially compact and may be disposed within a stretch of a flue pipe having an ordinary cross-sectional area.

INDUSTRIAL APPLICABILITY

The construction and method of use of the invention have been made amply clear by the foregoing description. It is apparent that although the heat recovery device is disclosed herein as being suitable for use with a furnace system employing a return air duct, the invention has clear applicability to many other operations wherein it is desired to transfer heat from a first flowing medium of one temperature to a second medium of a second temperature. Moreover, it is to be further noted that although the preferred form of the device is disclosed herein as being especially adapted for use in conjunction with flue pipes having a circular cross section, the invention is also well adapted for use with flue pipes having various other cross section configurations. Finally it should be observed that although the three stage structure is employed in connection with the preferred form of the device, each stage may be individually employed in particular applications with acceptable results.

From the foregoing, it is clear that the invention provides a novel device for recovering a substantial portion of the heat from a flue pipe in a furnace system which is especially effective in operation but yet which is particularly compact in size and may be easily installed in existing furnace systems. Thus, it will be observed that the device disclosed herein not only provides for the reliable accomplishment of the invention, but does so in a particularly simple and economical manner. It is recognized, of course, that those skilled in the art may make various modifications or additions to the preferred embodiment chosen to illustrate the invention without departing from the gist and essence of the present contribution to the art. Accordingly, it is to be understood that the protection sought and to be afforded hereby should be deemed to extend to the subject matter claimed and all equivalents thereof fairly within the scope of the invention.

I claim:

1. Apparatus for transferring heat from a first gas flowing through a heat conductive tubular member to a second gas in contact with the exterior surface areas of said member, including:

a heat trap disposed within said member adjacent said exterior surface areas of the latter, said heat trap including a heat conductive mesh-like material through which said first gas may pass, portions of said material being in heat conducting contact with interior surface portions of said member.

said material functioning to extract and store heat from said first gas, and further functioning to transfer said extracted heat by conduction and radiation thereof to said interior surface portions of said member for subsequent conduction to said exterior surface areas of said member, said mesh-like material comprising a plurality of separate, elongate, tubularly-shaped structures, each of said structures having one extremity thereof downstream in the flow of said first gas essentially closed to prevent free flow of said first gas therethrough, the opposite extremity of said structure upstream in said flow from said one extremity presenting an opening to said flow allowing said first gas to freely enter said structure.

2. The invention of claim 13, wherein: said structures are laterally spaced around said interior surface portions of said member, and there is further provided a baffle element disposed within each of said structures for regulating the volume of said first gas passing through said mesh-like material of the associated structure between said baffle element and said closed extremity of said associated structure.

* * * * *